United States Patent [19]

Fassler et al.

[11] 3,933,190

[45] Jan. 20, 1976

[54] METHOD FOR FABRICATING SHELL MOLDS FOR THE PRODUCTION OF SUPERALLOY CASTINGS

[75] Inventors: Michael H. Fassler, Portland; James S. Perron, Chester, both of Conn.

[73] Assignee: United Technologies Corporation, Hartford, Conn.

[22] Filed: Dec. 16, 1974

[21] Appl. No.: 533,374

[52] U.S. Cl. ..... 164/26; 164/43; 260/DIG. 40

[51] Int. Cl.[2] ..... B22C 9/04; B22C 3/00

[58] Field of Search ..... 164/8, 21, 25, 26, 41, 164/165, 341, 43; 260/DIG. 40

[56] References Cited

UNITED STATES PATENTS

| | | | |
|---|---|---|---|
| 3,743,003 | 7/1973 | Brown | 164/25 X |
| 3,748,157 | 7/1973 | Moore | 164/26 X |

FOREIGN PATENTS OR APPLICATIONS

| | | | |
|---|---|---|---|
| 924,510 | 4/1963 | United Kingdom | 164/26 |

*Primary Examiner*—Francis S. Husar
*Assistant Examiner*—Gus T. Hampilos
*Attorney, Agent, or Firm*—Charles E. Sohl

[57] ABSTRACT

A method for producing shell molds for the investment casting and subsequent directional solidification of nickel and cobalt based superalloys is described. The shell mold is composed of high purity alumina and characterized by the presence of silica in trace form only. The shell mold of the present invention is nonreactive with molten nickel and cobalt base superalloys even during exposures of up to 12 hours. Additionally the alumina shell mold of the present invention has a unique combination of mechanical strength and stability at elevated temperatures.

6 Claims, 2 Drawing Figures

METHOD FOR FABRICATING SHELL MOLDS FOR THE PRODUCTION OF SUPERALLOY CASTINGS

BACKGROUND OF THE INVENTION

Investment casting, also referred to as the lost wax process, is a casting process particularly suited for the production of small metal parts with extreme dimensional accuracy. The investment casting process is widely used for the fabrication of turbine and stator blades for gas turbine engines. Blades produced by this process have the advantage of requiring only minimal machining following casting. This process is discussed in U.S. Pat. Nos. to Earl, 1,831,555; Watts, 3,590,905; Horton, 3,686,006 and Moren, 3,179,523 and 3,196,505.

Turbine efficiency is closely related to operating temperature. Demands for improved efficiency have resulted in the development of more heat resistant alloys. These alloys are generally characterized by containing quantities of highly reactive alloy additions. The development of such improved alloys has required concurrent improvements in mold materials so as to reduce the interaction between the casting alloy and the mold surface. This type of interaction is highly undesirable since it results in surface defects in the cast product which can lead to failure either through corrosion or mechanical fatigue.

Another technique which has been employed to improve the high temperature properties of superalloys is directional solidification. In this technique a molten casting is slowly solidified at a controlled rate so that the interface between the molten and solidified alloy passes slowly along the longitudinal axis of the part. One result of this technique may be to produce a series of columnar grains with the longitudinal axis of the grains being oriented with the longitudinal axis of the casting. Improved longitudinal high temperature properties are obtained as a result of the reduction in grain boundary area perpendicular to the longitudinal axis. This technique is described in the VerSnyder U.S. Pat. No. 3,260,505. The solidification rates used in the directional solidification process can be relatively low, on the order of 0.1 to 1 inch per hour. Accordingly, substantial time periods of up to 12 hours may be required for the total solidification of a part produced by this process. The mold material adjacent to that part of the directionally solidified casting which solidifies last may therefore be exposed to the molten material for time periods of up to 12 hours. For this reason it has been found that many conventional mold materials which in the past have been found wholly satisfactory for nickel and cobalt superalloys, do not provide adequate performance when employed in the directional solidification process, particularly with some of the more advanced superalloys like those of the family of directionally solidified eutectics. Accordingly, it is the purpose of the present invention to describe a mold material and fabrication technique suited for the production of directionally solidified nickel and cobalt castings and other high temperature alloys.

SUMMARY OF THE INVENTION

The invention discloses a method for the production of shell molds suitable for the directional solidification of nickel and cobalt superalloys. Essential features of the method include the fact that in its final form, the mold material is composed of high purity alumina, essentially free from silica, and the fact that improved high temperature mold properties are obtained through control of the particle size of the refractory aggregate from which the mold is formed. The method includes highly specific composition limits and process limitations which provide optimum mold performance.

DESCRIPTION OF THE PREFERRED EMBODIMENT

Figure 1:
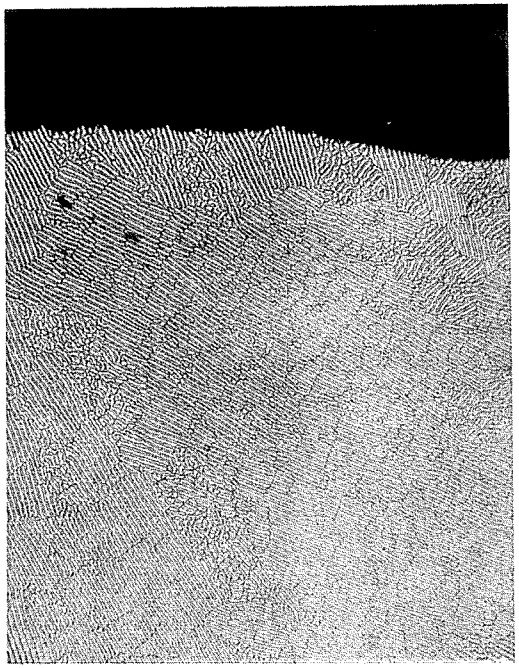
FIG. 1 is a micrograph, at a magnification of 200 x, showing the mold-metal interface between an all alumina mold and a directionally solidified nickel base eutectic alloy.

The present invention relates to a method for the production of shell molds for investment casting and directional solidification of superalloys.

Castable ceramic materials such as those used in mold production are generally composed of refractory particles, hereinafter called refractory aggregates, which are held together by a binder component. The prior art has disclosed the use of alumina in both the aggregate component and binder component. The alumina in the binder component is initially present in the form of a compound such as an aluminate which is transformed to alumina upon heating. U.S. Pat. Nos. to Earl 1,831,555 and to the Watts 3,590,905 disclose the use of alumina in the refractory aggregate, however, both of these patents view alumina as generally equivalent to other refractory materials including silica. Likewise, U.S. Pat. Nos. 3,196,505 to Morin and U.S. Pat. No. 3,321,005 to Lirones disclose the use of aluminate type compounds as a binding component, however, neither of these patents recognize the combination of refractory aggregate and binder component which are both silica free. British Pat. No. 924,510 granted to Hunter discloses the use of an alumina refractory with an aluminate type of binder, however, the Huntner patent does not disclose the particular method of production which will be disclosed below, and further the patent fails to disclose the particular size of refractory aggregate which has been found to provide maximum high temperature mechanical properties.

The method of the present invention involves the formation of a ceramic mold about the exterior of a pattern made from wax or similar material. Briefly, the mold is formed by repetitively dipping the pattern into a liquid ceramic slurry, applying a dry particulate ceramic material, and allowing the coating to dry. This process is repeated until a mold of the desired thickness is obtained. The present invention resides in the slurry composition, the particulate size, and also resides in the particular sequence of steps.

A wax pattern is initially dipped into a slurry containing:

A. from 15 to 25 parts of an aqueous solution containing about 50 percent aluminum polyoxychloride
B. from 6 to 10 parts water
C. from 8 to 14 parts of a binding agent such as latex
D. from 25 to 35 parts of alumina having −325 mesh particle size
E. from 7 to 12 parts of alumina having a −100 mesh particle size F. from 10 to 20 parts of alumina having a −38/+100 mesh particle size G. from 0.5 to 1.5 parts of pH control agent such as a 2 percent aqueous solution of HCl.

It is critical to the success of the present invention that the overall silica level of the slurry set forth above be les than 0.3 percent.

The aluminum polyoxychloride serves as a binding agent and upon high temperature exposure the aluminum polyoxychloride decomposes to form alumina. An optional added element to the above slurry is from 0.5 to 1.5 parts of calcium nitrate. The calcium nitrate aids the sintering of the alumina and permits this sintering to occur at substantially lower temperatures. However calcium nitrate is not essential to the proper functioning of the slurry or subsequently formed shell mold.

The latex component serves as a low temperature binder and gives low temperature strength prior to the high temperature heat treatment.

The essential key to the improved high temperature strength which characterizes the mold material of the present invention is the particular mixture of coarse and fine alumina particles used in fabricating the mold. Coarse alumina particles are considered to be those on the order of −100 mesh or larger and fine alumina particles are those on the order of −325 mesh. Within the ranges set forth for the slurry optimum high temperature mechanical properties are obtained when the ratio of fine alumina to coarse alumina is from 6:1 to 1:1. A slurry with a greater proportion of fine alumina particles is too viscous to provide a satisfactory slurry and further a mold made from this type of material lacks high temperature strength. Slurries with too great a proportion of coarse alumina particles will not provide the mold density and strength levels necessary for good results. Additionally a slurry lacking in fine particles will not provide as smooth a casting surface as will a slurry containing fine particles.

A dilute hydrochloric acid solution is used to maintain the desired slurry viscosity. It has been found that a pH of 3 or less is necessary for proper results from the above described slurry. When the pH is from 4–9 the slurry is too viscous for proper functioning.

An an optional added element the slurry may contain 0.05 to 0.25 parts of a conventional wetting agent. A wetting agent will improve the mixing of the slurry and will improve the adherence of the slurry to the wax pattern.

After the pattern is dipped in the slurry and withdrawn a layer of the slurry material will adhere to the surface of the pattern. This surface layer is allowed to dry, usually at room temperature. After the first slurry coat has dried the pattern is dipped into the slurry a second time and withdrawn. After the pattern is withdrawn a layer of dry alumina particles having the size of −38 +100 mesh is applied and the pattern is then allowed to dry. The dried pattern is then dipped in ethyl alcohol, then into the slurry, and then a layer of alumina particles having a size of −28 to +48 mesh is applied. The ethyl alcohol dip, slurry dip and −28/48 mesh alumina particle treatment is repeated a plurality of times when intervening drying steps until the desired mold thickness is obtained. This mold thickness is usually in the range of from 0.1 to 0.5 inches. For thicker molds, coarser alumina such as −14/50 mesh may be used during the later coating steps.

When the desired mold thickness is obtained the wax pattern is removed by heating the wax to above its melting point and allowing it to flow from the mold. The wax removal temperature is usually in the range of from 400° to 500°F.

Following the removal of the wax the mold is heated to a temperature of from 2100° to 2700°F to remove all traces of the wax pattern and to consolidate and sinter the mold material through the decomposition of the aluminum polyoxychloride. During this heating step the low temperature latex binder decomposes and vaporizes.

It is critical to the proper function of the shell mold that the silica content be minimized. The silica level must be controlled so as to be less than 0.3%. Silica should be avoided even in the outer portion of the mold since it may decompose into gaseous silicon monoxide which may diffuse through the mold and react with the metal.

The range of alumina particle size used in the production of the shell mold and the order in which the various size particles are applied have been carefully selected so as to provide optimum mechanical properties at the elevated temperature to which the mold will be subject in service. Molds made according to the present invention will have a significant amount of porosity which tempers the effect of thermal shock.

The resultant mold is extremely resistant to attack by molten superalloys even after extended exposure of as much as 12 hours. Accordingly molds made according to the method of the present invention are particularly suited in the production of directionally solidified metal castings and single crystals wherein portions of the mold must withstand exposure to molten metal for extended periods of time. The present invention will be made more clear through reference to the following illustrative examples.

EXAMPLE I

Shell molds were formed using two different methods. The first method was according to the preferred embodiment of the present application while the second method was essentially equivalent to that disclosed in examples 8 or 9 of the British Pat. No. 924,510.

Four shell molds were formed around a ¾-inch square wax rod. The sequence of steps used was identical to that disclosed as the preferred embodiment in the present application. The resultant mold had a thickness of one-eighth inch. Dewaxing was successfully performed using a high temperature, high pressure steam autoclave, and the final mold was suitable for superalloy casting.

Four further molds were formed as follows:

350 grams of $H_2O$ and 150 grams of aluminum polyoxychloride were vigorously mixed. To this mixture was added 1,000 grams −325 mesh alumina (surface area approximately 13,500 $cm^2$/gram) and 1,000 grams of +200 mesh alumina. This composition was thoroughly mixed to obtain a thick slurry. Four shell molds were prepared by repetitively dipping a ¾-inch square wax rod into the slurry. The slurry was allowed to air dry between dips. Six dips were required to attain a ⅛-inch thickness. After the final coat, the molds were air dried. One of the four molds cracked during air drying. The three intact molds were then dewaxed in an autoclave under the same conditions as the molds made according to the preferred embodiment. Each of the three molds failed catastrophically due to the stresses which occurred during dewaxing.

EXAMPLE II

Samples of the mold material of Example I were evaluated for porosity by weighing before and after saturating the samples with water. The samples from the mold made according to the present invention had 12% more porosity than the molds made according to the prior art.

EXAMPLE III

Figure 2:
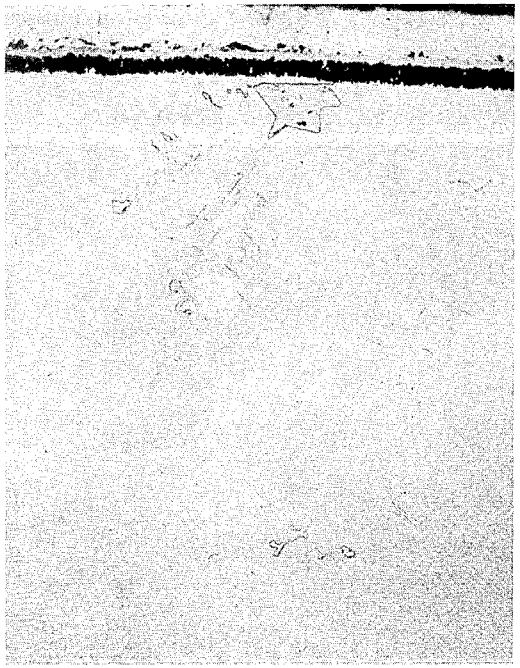
FIG. 2 is a micrograph, at a magnification of 200 x, showing the mold-metal interface between a silica bonded alumina mold and a directionally solidified nickel base eutectic alloy.

Two shell molds were prepared. One mold was made from alumina bonded with alumina as taught in the preferred embodiments of the present application while the other mold was made from alumina bonded with silica as known from the prior art. A nickel-base eutectic alloy containing about 4% aluminum, about 23% columbium, balance essentially nickel, was cast in these molds at a temperature of about 3,000°F. This alloy is described in U.S. Pat. No. 3,554,817, to Thompson and assigned to the assignee of the present application. The alloy was solidified at a rate of approximately 1 inch per hour with portions of the metal remaining molten for up to about 8 hours. FIGS. 1 and 2 are photomicrographs of castings from the all alumina mold and the alumina-silica mold respectively. The photomicrographs were taken from those parts of the casting which were last to solidify and thus were the most likely to interact with the mold material. The light area is the cast metal. (The light surface layer in FIG. 2 is a layer of nickel plate which was applied to protect the surface during metallographic preparation.) FIGS. 1 and 2 were both taken at magnifications of 200×. FIG. 1 shows a sample which was etched to show microstructural details while FIG. 2 shows an unetched sample. In FIG. 2 there is definite visual evidence of metal-mold interaction extending as far as about 0.015 inch into the casting. In a thin section casting such as a gas turbine blade, such a degree of reaction would be intolerable. Virtually no metal-mold interaction is visible in FIG. 1.

EXAMPLE IV

Two molds were made as described in Example III, one all alumina, made according to the preferred embodiments of the present invention and the second made of alumina bonded with silica. A nickel-base superalloy having a nominal composition of 23.5% chromium, 10% nickel, 7% tungsten, 3.5% tantalum, 0.5% carbon, 0.45% zirconium, 0.25% titanium, balance essentially nickel, was melted and cast into the molds at a temperature of 2750°F. The castings were allowed to solidify normally, i.e. not directionally solidified, and then examined metallographically. The casting from the all alumina mold showed no evidence of mold-metal interaction, but the casting made in the alumina-silica casting had reaction products which extended into the mold approximately 0.001 inch.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. A method for the fabrication of shell molds suited for use in the production of directionally solidified components made from nickel and cobalt base alloys, comprising the steps of A. providing a pattern which duplicates the size and shape of the desired final product, said pattern being made of wax or similar material;

B. providing a slurry containing from 15 to 25 parts of an aqueous solution containing about 50% aluminum polyoxychloride, from 6 to 10 parts water, from 8 to 14 parts of a binding agent such as latex, from 25 to 35 parts of −325 mesh alumina, from 7 to 12 parts of −100 mesh alumina, from 10 to 20 parts of −38/+100 mesh alumina, and from 0.5 to 1.5 parts of a pH control agent such as a 2% aqueous solution of HCl;

C. dipping the pattern into the slurry so as to coat the pattern with the slurry;

D. drying the coated pattern;

E. dipping the coated pattern into the slurry and then applying dry −38/+100 mesh alumina;

F. drying the coated pattern;

G. dipping the coated pattern into ethyl alcohol, then into the slurry, and then applying dry −28/+48 mesh alumina;

H. drying the coated pattern;

I. repeating steps G and H a plurality of times;

J. removing the wax by heating the coated pattern to a temperature in excess of the melting temperature of the pattern material;

K. firing the mold at an elevated temperature to remove all pattern residue and consolidate the shell mold;

whereby the resultant shell mold is composed of substantially pure alumina and is resistant to attack by molten nickel and cobalt alloys during exposures of up to 12 hours.

2. A method as in claim 1 wherein the slurry contains from 0.5 to 1.5 parts calcium nitrate in addition to the elements recited.

3. A method as in claim 1 wherein the slurry contains from 0.05 to 0.25 parts of a wetting agent in addition to the elements recited.

4. A method as in claim 1 wherein the ratio of fine alumina to coarse alumina in the slurry is from 6:1 to 1:1.

5. A method as in claim 1 wherein the firing temperature is from 2100° to 2700°F.

6. A slurry material suitable for the production of alumina shell molds, for casting superalloys, consisting of:

A. from 15 to 25 parts of an aqueous solution containing about 50 percent aluminum polyoxychloride;

B. from 6 to 10 parts water;

C. from 8 to 14 parts of a binding agent such as latex;

D. from 25 to 35 parts of alumina having −325 mesh particle size;

E. from 7 to 12 parts of alumina having a −100 mesh particle size;

F. from 10 to 20 parts of alumina having a −38/+100 mesh particle size;

G. from 0.5 to 1.5 parts of pH control agent such as a 2 percent aqueous solution of HCl.

* * * * *